United States Patent [19]

Gabr

[11] 3,995,124

[45] Nov. 30, 1976

[54] NOISE CANCELLING MICROPHONE

[76] Inventor: Saad Zaghloul Mohamed Gabr, 81 Old Dover Road, Canterbury, Kent, England

[22] Filed: Oct. 15, 1974

[21] Appl. No.: 514,779

[52] U.S. Cl. ..... 179/139; 179/121 D
[51] Int. Cl.[2] ..... H04R 1/32; H04R 1/40
[58] Field of Search ..... 179/1 DM, 107 FD, 116, 179/121 D, 179, 139, 121 R, 138 R, 111 R; 181/148, 158, 198

[56] References Cited

UNITED STATES PATENTS

| | | | |
|---|---|---|---|
| 2,305,599 | 12/1942 | Bauer | 179/121 D |
| 2,463,762 | 3/1949 | Giannini | 179/179 |
| 2,552,878 | 5/1951 | Wiggins | 179/116 |
| 2,611,035 | 9/1952 | Duncan | 179/1 DM |
| 2,939,922 | 6/1960 | Görike | 179/111 R |
| 3,414,689 | 12/1968 | Gummel et al. | 179/121 R |
| 3,536,862 | 10/1970 | Weingartner | 179/121 D |
| 3,856,995 | 12/1974 | Cragg et al. | 179/179 |
| R27,487 | 9/1972 | Hassler | 179/121 D |

FOREIGN PATENTS OR APPLICATIONS

| | | | |
|---|---|---|---|
| 640,870 | 7/1928 | France | 179/111 R |

*Primary Examiner*—George G. Stellar
*Attorney, Agent, or Firm*—Young & Thompson

[57] ABSTRACT

A microphone unit comprises a pair of like electroacoustic transducers each having sound-responsive elements in the form of identical diaphragms which are parallel to each other and mounted in a common housing that is open at at least one end for the reception of desired sounds in a direction perpendicular to the diaphragms. The diaphragms are spaced apart a distance no greater than one-quarter of the shortest wavelength of the range of frequencies of the noises to be cancelled; and the housing has further apertures that open into the housing in directions parallel to the planes of the diaphragms, these further apertures being disposed at least one on each side of each diaphragm and the interior ones of said further apertures being spaced apart from their associated diaphragm a distance no greater than one-eighth of the shortest wavelength of the range of frequencies of the noises to be cancelled. The noise sources and channels that the microphone may be exposed to are 1. air-borne ambient noises;
2. air-borne noises due to reflection and echoes;
3. direct vibration transmitted to the microphone housing through non-air channels by contact and/or mounting; and
4. microphony effects of the housing, that is, vibration produced by the housing due to all air-borne sources.

Air-borne ambient noises, direct vibrations, and microphony noises will be cancelled by the arrangement of the transducers; while echoes, and reflections, as well as ambient noises, will be attenuated by the presence of the further apertures.

9 Claims, 3 Drawing Figures

NOISE CANCELLING MICROPHONE

The invention relates to microphone units and in particular to microphone units arranged so as to operate with substantial freedom from echoes and noises, such as ambient and field noises.

Except in relatively unusual circumstances, a microphone unit will be exposed in use not only to incoming sound vibrations which it is desired to convert to an electrical output signal, but also to sound and/or mechanical vibrations, as from the engine of a vehicle in which the unit as mounted, which should provide no part of this output. In some instances for example where a microphone unit is used in a crowd or in proximity to machinery, substantially complete elimination of unwanted sound vibrations is essential if the unit is to provide an output which can be understood when converted to sound through a loudspeaker.

The invention is accordingly concerned with the provision of a microphone unit including features whereby the effects on the electrical output of unwanted incoming sound - noise and echo - are largely if not completely eliminated.

The invention provides a microphone unit comprising one or a pair of like electro-acoustic transducers, the or each transducer having a sound responsive element, means mounting the transducer means within a housing apertured to expose both sides of the or each sound-responsive element substantially equally to unwanted and random noise and to expose one side of the or one sound responsive element to a desired sound input.

The unwanted sound vibrations reach the diaphragm or other sound responsive element of the or each transducer directly, through air, and also by microphony that is by way of the structure of the microphone and the housing and other mounting of the transducer or transducers. The effect of airborne noises on a microphone is reduced by arranging that the two sides of its diaphragm are exposed substantially equally to such noises, so that the resulant of such noises in the movement of the diaphragm and thus in the signal output is substantially zero.

The effect of unwanted noises reaching the diaphragm through the associated supporting and mounting structure can be dealt with by making the structure of a large number of parts of three or more different materials and preferably arranging that a part of one material is not adjacent a part of the same material. The structure is thus rendered substantially acoustically non-conductive or "dead". Alternatively or in addition, two identical microphones arranged as described with respect to the wanted incoming sound can be electrically connected so that the combined output is substantially free of sound components due to these noises. When used in association with one or more loudspeakers as in a loudspeaking telephone or public address system, the outputs of the two microphones can instead be analysed if required to separate out a substantially pure noise or unwanted component for cancellation purposes as described in my copending Application Ser. No. 425,527, filed Dec. 17, 1973 now U.S. Pat. No. 3,922,488. The invention then provides combined acoustic and electronic noise cancellation techniques to deal with both direct and indirect, airborne noise and the mechanical vibration channel by which random external noises and echo can impose on the output signal obtained from a microphone.

The invention will be more readily understood from the following illustrative description and accompanying drawing, in which.

Figure 1:
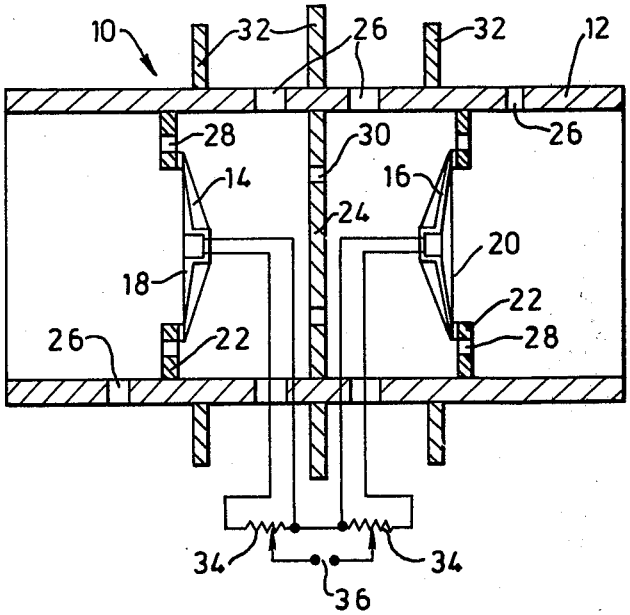
FIG. 1 is a schematic sectional side view of a microphone unit embodying the invention.

Referring to FIG. 1, there is illustrated therein a microphone unit 10 comprising a tubular housing 12 open at both ends and containing two electro-acoustic transducers 14, 16 for use as microphones. The transducers 14, 16 can be of the moving coil or any other suitable kind. The transducer 14 is shown by way of example as being a moving coil microphone having a substantially planar diaphragm 18 whilst the transducer 16 is shown as a microphone of the same general kind but having a convention conical diaphragm 20. It will be understood however that in practice the two microphones employed in any microphone unit embodying the invention will be substantially identical for reasons of symmetry. The diaphragms of the electro-acoustic transducers extend at right angles to the axis of the housing 12.

The housing which may be of circular or other desired cross-section has two annular partitions 22 on which the transducers are mounted, and an internal baffle 24 which accoustically separates the two transducers. The baffle 24 may however be omitted. To ensure access of random sound to the inner sides of the transducer diaphragms one or more apertures are provided in the housing wall and/or the partitions at 26 and 28 respectively. The baffle 24 may also be provided with one or more apertures as at 30. If desired, means may be provided to permit selective adjustment of the effective area of the apertures, such means being preferably readily operable from outside the housing.

The microphone unit is intended to be used with one end thereof directed to the users mouth, and may be additionally shaped or provided with a handle to facilitate this. The nearer micrphone thus has one side directly exposed to the wanted sound signals. To minimise exposure of the other microphone to this wanted sound, one or more external baffles 32 can be provided on the housing. The ends of the housing 12 can extend outwardly beyond the transducers, if required to provide loading chambers for the transducers, which may but need not be identical.

The outputs of the coils of the transducers 14, 16 are connected subtractively, in out of phase relationship, through potentiometers 34, so that the output of each microphone can be selectively adjusted. The output of the microphone unit is obtained from terminals 36 and will be understood to be the difference between the microphone outputs as taken from the potentiometers 34.

Sounds incident upon the microphone unit 10 can be resolved into sounds parallel to the planes of the diaphragms 18, 20, which sounds can be regarded as noise or unwanted sounds, and sound perpendicular to the diaphragms which can be regarded as wanted sounds. The former sounds will bring about impulses on the two diaphragms which are identical in all respects, assuming the diaphragms to be in adjacency, with the distance between them comparable to the wavelength of the sounds. It has been found in practice that the distance should not be greater than ¼ of the wavelength of the frequency concerned or ¼ of the wavelength of the highest frequency to be handled by the unit. The forces produced are then substantially equal. For best results of course the distance should be kept smaller than this.

Incident sounds moving parallel to the diaphragms then produce a movement of each diaphragm which is theoretically zero and which is normally negligably small. The electrical signals resulting from any such negligably small movement are added out of phase, leading to substantially complete cancellation of any electrical output due to them.

Incoming sounds, resolved into the direction perpendicular to the diaphragms, apply their maximum force to the respective diaphragm first encountered. If the baffle 24 is provided, the other diaphragm of course remains unaffected by this sound and the output from the diaphragm receiving this wanted signal is substantially unchanged by the sound travelling parallel to the diaphragm. If there is no baffle between the two diaphragms, the second diaphragm, which does not directly receive the incoming wanted sound, moves in sympathy with the first mentioned diaphragm because of the vibrations of the first mentioned diaphragm conveyed through the air between them.

In use, the microphone unit 10 will be effectively echo-cancelling. Desired sound, for example, from a speaker holding the unit so that he directly faces one of the transducers will be fully reproduced in the electrical output, as also will speach from a second speaker opposite the first. The potentiometers 34 permit adjustment of the unit to compensate for departures thereof from exact symmetry, electrical or structural, about the central transverse plane of the housing 12. Although the unit shown in FIG. 1 has two microphone transducers, the invention can be embodied in a unit housing only a single transducer. Such a single microphone can be of the form of the transducer 16 of FIG. 1 but is preferably of the form of the transducer 14 for a closer approach to symmetry which can be achieved or simulated precisely by duplicating the microphone supported on either side of the diaphragm or by adding a dummy structure. In other respects, the single microphone unit is rendered as nearly as possible symmetrical not only about the diaphragm axis, as is the unit of FIG. 1, but also about the diaphragm plane, which of course occupies the position of the central plane of the baffle 30 in the unit of FIG. 1.

As with the unit of FIG. 1, the single transducer arrangement provides for ambient sound to fall substantially equally on the two sides of the diaphragm and for speech or other wanted sound to full predominantly on only one.

Either form of unit will be seen to be free of focussing, sound guidance, or reflecting means such as tunnels or baffles acting between the exposed diaphragm sides and the extension of the unit.

Figure 2:
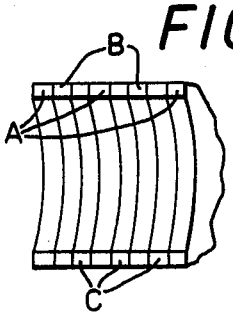
FIG. 2 is a partial schematic sectional view of a housing for use in the unit of FIG. 1.

The structure of the housing, the nature and dimensions of the various parts of the unit theoretically do not affect the performance of the unit, but are preferably chosen so as to assist as much as possible the elimination of the effects of noise and echoes. Thus the housing is preferably built up in a manner similar to that illustrated in FIG. 2 which shows a tubular housing made from a plurality of rings of like inner and outer diameter arranged in co-axial alignment to form a tube. The rings are made of different materials A, B, C each having different sound conductive properties. Thus one ring may be formed of metal, the next made of glass fibre and the third of rubber or a hard or soft plastics material. Sound transmitted through any one ring to the next is very substantially attenuated at the interface and the whole structure is effectively acoustically "dead" or non-microphonous. Instead of repeating the sequence of, say, metal, glass fibre and plastics rings, it is preferred instead to use for the next three rings the same three materials but in a different order, again as shown in FIG. 2. The next three rings can then be arranged in a further different order. In this way each ring has on either side of it a ring of different material. Obviously this aspect of the invention is not confined to the use of three materials only, to the materials mentioned above, or to any particular sequence in which the rings are arranged.

Figure 3:
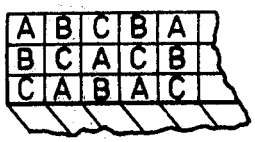
FIG. 3 is a like view of another form of housing for use in the unit.

It will be appreciated that a tubular microphone housing built up as described will have almost infinite resistance to sound conduction in the axial direction. Sound conductivity within each ring radially of the housing will however be no more reduced than if the housing were constructed of an integral piece of the material of the ring. In order to obtain the required high sound attenuation characteristics in the radial direction also, the housing can be formed not simply of axially adjacent single rings but of axially adjacent concentric rings, preferably at least three in number and again of different materials, as shown in FIG. 3.

It will be evident that the structure described for a microphone housing can be adapted readily to housings of any shape, and to housings and sub-housings for other apparatus than the microphone unit described. Thus flat panels can be formed from several layers of different material the layers themselves being made up of parts of different material. The various components of the housing described can be connected together in any suitable way, as by adhesive layers, or by snap-fitting inter-connections making use of resilience inherently possessed by some of the materials used.

The invention can of course be applied to hearing aid equipment to eliminate instability and inadequate operation due to acoustic feed-back which takes place in such equipment mainly through microphony and mechanical vibrations.

The invention can of course be embodied in various ways other than as specifically described without departing from the scope thereof.

I claim:

1. A microphone comprising a pair of like electroacoustic transducers each having a sound-responsive element, housing means within which said transducers are mounted, said transducer sound-responsive elements being identical and parallel to each other and spaced apart a distance no greater than one-quarter of the shortest wavelength of the range of frequencies to be cancelled, said transducers having electrical outputs connected in subtractive relation, said housing means having at least one main sound inlet aperture that opens into said housing means in a direction perpendicular to said transducer sound-responsive elements, said housing means having further apertures that open into said housing in directions parallel to said transducer sound-responsive elements, said further apertures being disposed at least one on each side of each said transducer sound-responsive element and the interior ones of said further apertures being spaced apart from their associated said transducer sound-responsive element a distance no greater than one-eighth of the shortest wavelength of the range of frequencies to be cancelled.

2. A microphone as claimed in claim 1, in which said transducer sound-responsive elements are coaxial.

3. A microphone as claimed in claim 1, in which said housing means has a baffle acoustically isolating the transducers from each other.

4. A microphone as claimed in claim 3, in which said baffle has at least one aperture providing acoustic communication.

5. A microphone as claimed in claim 1, and variable resistance means between the transducers and output terminals of the unit for selective adjustment of the contributions of the transducer outputs to the output of the unit.

6. A microphone as claimed in claim 1, each transducer being mounted on an annular partition within the housing means.

7. A microphone as claimed in claim 6, each said partition having at least one aperture therethrough providing acoustic communication.

8. A microphone as claimed in claim 1, in which said housing means comprises a plurality of housing elements each of one of three different materials, no element having a surface thereof in abutment with an element of like material.

9. A microphone as claimed in claim 1, and at least one external baffle on said housing means.

* * * * *